US010400364B1

(12) United States Patent
Mayer et al.

(10) Patent No.: US 10,400,364 B1
(45) Date of Patent: Sep. 3, 2019

(54) FABRICS WITH CONDUCTIVE PATHS

(71) Applicant: Apple Inc., Cupertino, CA (US)

(72) Inventors: Kirk M. Mayer, San Francisco, CA (US); Yohji Hamada, Wakayama (JP); Daniel A. Podhajny, San Jose, CA (US); Daniel D. Sunshine, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/677,944

(22) Filed: Aug. 15, 2017

Related U.S. Application Data

(60) Provisional application No. 62/397,105, filed on Sep. 20, 2016.

(51) Int. Cl.

| | |
|---|---|
| ***D02G 3/44*** | (2006.01) |
| ***D03D 1/00*** | (2006.01) |
| ***D03D 15/00*** | (2006.01) |
| ***H01B 5/00*** | (2006.01) |

(52) U.S. Cl.
CPC ..... *D02G 3/441* (2013.01); *D03D 1/0088* (2013.01); *D03D 15/00* (2013.01); *H01B 5/002* (2013.01)

(58) Field of Classification Search
CPC ..... D02G 3/441; D03D 1/0088; D03D 15/00; H01B 5/002
USPC ..... 174/70 R
See application file for complete search history.

(56) References Cited

U.S. PATENT DOCUMENTS

| | | | | |
|---|---|---|---|---|
| 4,468,702 | A * | 8/1984 | Jandrell | H01J 29/868 174/392 |
| 4,735,833 | A * | 4/1988 | Chiotis | C08J 3/241 156/155 |
| 6,210,771 | B1 | 4/2001 | Post et al. | |
| 7,592,276 | B2 | 9/2009 | Hill et al. | |
| 8,721,362 | B2 * | 5/2014 | Kato | D03D 3/005 439/502 |
| 2002/0094739 | A1 * | 7/2002 | Lutke-Foller | D03D 15/02 442/181 |
| 2006/0257720 | A1 * | 11/2006 | Hirahara | H01M 4/8605 429/492 |
| 2008/0196783 | A1 | 8/2008 | Van Bruggen et al. | |

(Continued)

FOREIGN PATENT DOCUMENTS

GB 2365132 * 2/2002 ..... G06F 1/1632

*Primary Examiner* — Timothy J Thompson
*Assistant Examiner* — Charles Pizzuto
(74) *Attorney, Agent, or Firm* — Treyz Law Group, P.C.; Kendall W. Abbasi

(57) ABSTRACT

A fabric-based item may have fabric with conductive strands and insulating strands. The conductive strands may form conductive signal paths and may be coupled to control circuitry. The conductive strands and insulating strands may be woven in a construction that allows multiple conductive strands to contact one another to form a low resistance signal path such as a power line, a data line, or a ground line. The fabric may have a two up and three down twill pattern, a two up and three down twill pattern, or other suitable pattern. The pattern may be selected so that groups of conductive weft strands or groups of conductive warp strands are in contact with one another. The conductive strands may have greater density than the insulating strands. For example, if the weft strands are conductive, the fabric may have a higher number of picks per inch than ends per inch.

21 Claims, 13 Drawing Sheets

(56) References Cited

U.S. PATENT DOCUMENTS

| | | | | |
|---|---|---|---|---|
| 2010/0208445 | A1 | 8/2010 | Asvadi et al. | |
| 2014/0191211 | A1* | 7/2014 | Chabrecek | D03D 1/0088 257/40 |
| 2017/0056644 | A1 | 3/2017 | Chahine | |
| 2017/0060192 | A1* | 3/2017 | Cousins | H05K 1/111 |
| 2017/0075481 | A1* | 3/2017 | Chou | G06F 3/044 |
| 2017/0178840 | A1* | 6/2017 | Hegde | H01H 13/83 |

* cited by examiner

FABRICS WITH CONDUCTIVE PATHS

This application claims the benefit of provisional patent application No. 62/397,105, filed Sep. 20, 2016, which is hereby incorporated by reference herein in its entirety.

FIELD

This relates generally to fabrics and, more particularly, to fabrics with conductive paths.

BACKGROUND

Electronic devices often include signal paths for carrying electrical current. In some applications, it may be desirable to form parts of an electronic device from fabric. For example, a flexible electronic device may have fabric portions that allow the electronic device to bend and flex.

It can be challenging to form conductive signal paths in fabric items. The fabric may have portions that are plated with metal to form a conductive signal path, but the metal plating may be susceptible to damage after repetitive bending of the fabric.

SUMMARY

A fabric-based item may have fabric with conductive strands and insulating strands. The conductive strands may form conductive signal paths and may be coupled to control circuitry. The conductive strands and insulating strands may be woven in a construction that allows multiple conductive strands to contact one another to form a low resistance signal path such as a power line, a data line, or a ground line.

The fabric may have a two up and three down twill pattern, a two up and three down twill pattern, or other suitable pattern. The pattern may be selected so that groups of conductive weft strands or groups of conductive warp strands are in contact with one another. The conductive strands may have greater density than the insulating strands. For example, if the weft strands are conductive, the fabric may have a higher number of picks per inch than ends per inch.

In some applications, the fabric may be used as a cover for an electronic device. The cover may be flexible and may be bent to function as a stand for the electronic device. The fabric may have a bend axis around which the fabric folds when used as a stand. The conductive signal paths in the fabric may intersect with the bend axis. By weaving the conductive signal paths into the fabric, the conductive signal paths may be flexible and capable of withstanding the bending of the fabric.

DETAILED DESCRIPTION

Figure 1:
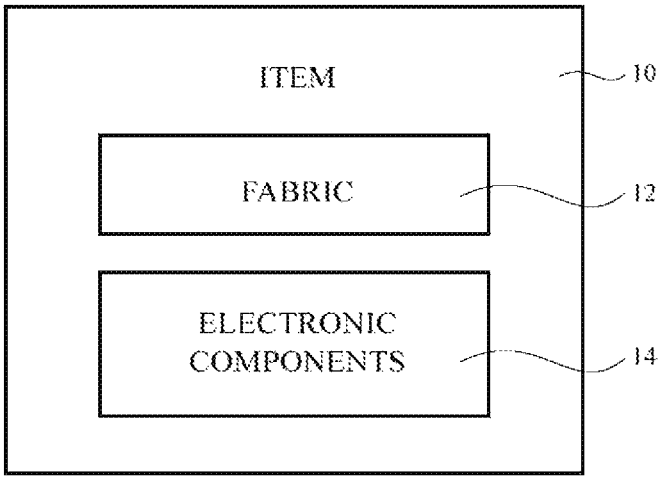
FIG. 1 is a schematic diagram of an illustrative item that may include fabric with conductive yarn in accordance with an embodiment.

An item such as a fabric-based item may contain fabric formed from intertwined strands of material. As shown in FIG. 1, for example, item 10 may contain fabric 12. Item 10 may also include circuitry such as electrical components 14. The circuitry of components 14 may include input-output devices such as buttons, touch sensors, light-based sensors such as light-based proximity sensors, force sensors, environmental sensors such as temperature sensors and humidity sensors, other sensors, status indicator lights and other light-based components such as light-emitting diodes for forming displays and other light-emitting structures, vibrators or other haptic output devices, etc. The circuitry of components 14 may also form control circuitry (e.g., processors, touch sensor circuits, etc.). Fabric 12 may, if desired, include conductive strands of material that are coupled to electrical components 14, control circuitry formed from processors and other circuits in components 14, and other circuitry in item 10. The conductive strands may serve as signal paths that carry signals between input-output components and control circuitry and may serve as capacitive touch sensor electrodes and other conductive structures in item 10.

The control circuitry formed from components 14 may include processors (e.g., microprocessors, microcontrollers, digital signal processors, baseband processors in wireless circuits, application-specific integrated circuits, and other control circuitry), may include control circuitry for processing sensor signals (e.g., capacitive touch sensor circuitry for gathering touch sensor data from capacitive sensor electrodes), and may include storage (e.g., volatile and non-volatile memory for storing data and code, etc.).

Item 10 may be a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic item 10 is mounted in a kiosk, in an automobile, airplane, or other vehicle, other electronic equipment, or equipment that implements the functionality of two or more of these devices. If desired, item 10 may be a removable external case for electronic equipment or other device accessory, may be a strap, may be a wrist band or head band, may be a removable cover for a device, may be a case or bag that has straps or that has other structures to receive and carry electronic equipment and other items, may be a necklace or arm band, may be a wallet, sleeve, pocket, or other structure into which electronic equipment or other items may be inserted, may be part of a chair, sofa, or other seating (e.g., cushions or other seating structures), may be part of an item of clothing or other wearable item (e.g., a hat, belt, wrist band, headband, shirt, pants, shoes, etc.), or may be any other suitable item that includes circuitry.

Figure 2:
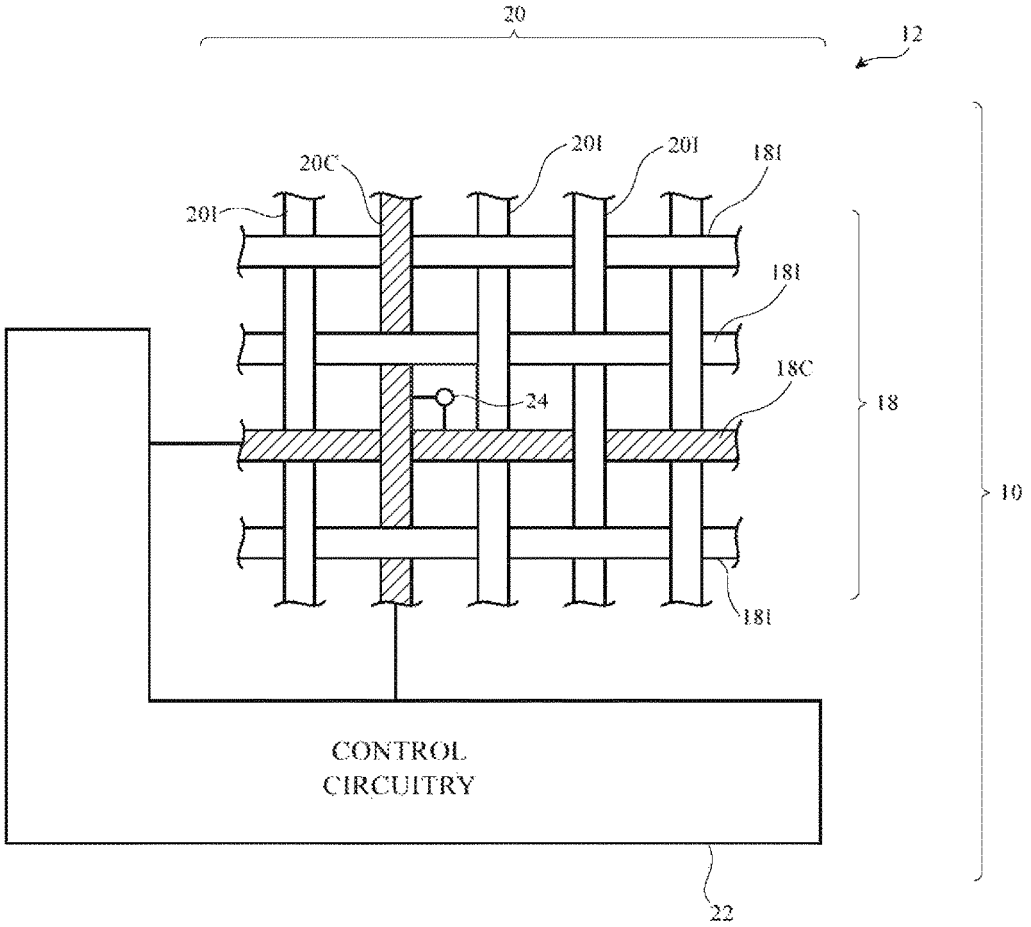
FIG. 2 is a diagram showing how conductive yarn in a fabric may be coupled to control circuitry in accordance with an embodiment.

As shown in FIG. 2, item 10 may include fabric 12 and control circuitry 22 (e.g., control circuitry formed from components 14, as described in connection with FIG. 1). Fabric 12 may be woven fabric, knit fabric, braided material, felt, or other suitable fabric formed from intertwined strands of material. In the illustrative arrangement of FIG. 2, fabric 12 is woven fabric that is formed from warp strands 20 and weft strands 18. Fabric 12 may include insulating strands such as strands 18I and 20I and may include conductive strands such as strands 18C and 20C. Conductive strands of material in fabric 12 may be used in conveying signals between control circuitry 22 and electrical components (see, e.g., illustrative electrical component 24, which has a first terminal coupled to conductive strand 20C and a second terminal coupled to conductive strand 18C).

Components such as component 24 may be input-output components such as buttons, touch sensors, light-based sensors such as light-based proximity sensors, force sensors, environmental sensors such as temperature sensors and humidity sensors, other sensors, status indicator lights and other light-based components such as light-emitting diodes for forming displays and other light-emitting structures, vibrators or other haptic output devices, etc. In configurations such as these, circuitry 22 may gather sensor signals or other signals from components 24 using conductive strands in fabric 12 or may apply control signals to components 24 using conductive strands in fabric 12 (e.g., to light up light-emitting diodes in fabric 12 to display images or other light output on fabric 12, to generate haptic output, etc.).

If desired, fabric 12 may include a grid of intersecting horizontally extending conductive strands (e.g., weft strands 18C in the example of FIG. 2) and perpendicular vertically extending conductive strands (e.g., warp strands 20C in the example of FIG. 2). The conductive paths (lines) in the grid formed from conductive strands 18C and 20C may serve as capacitive electrodes in a capacitive touch sensor (touch sensor grid). In this type of arrangement, control circuitry 22 may include capacitive touch sensor circuitry that is coupled to the conductive strands in the grid. The touch sensor circuitry may provide drive signals to the vertical (or horizontal) lines and may gather corresponding sense signals from the horizontal (or vertical) lines. Capacitive coupling between the drive and sense lines varies in the presence of a user's finger over a drive-line-to-sense-line intersection. As a result, the touch sensor circuitry in control circuitry 22 can process the drive and sense signals to determine which of the intersections of the conductive horizontal and vertical lines are being overlapped by a user's finger(s) or other external objects. Touch input that is detected this way (e.g., multitouch input corresponding to a pinch to zoom gesture, a multi-finger or single finger tap or swipe, or other touch input) may be used by item 10 to perform any suitable action. For example, in configurations in which item 10 has the ability to play media for a user, the touch input may be used to control media playback operations, in configuration in which item 10 has the ability to display images, displayed image content may be adjusted based on the touch input, in configurations in which item 10 includes or communicates with cellular telephone circuitry, touch input may direct item 10 to answer or place a telephone call, etc.

Fabric 12 may be formed inside item 10 or may be formed on the surface of item 10 (e.g., on an exterior wall, the surface of a housing, the surface of a strap or other fabric structure, etc.). In configurations in which conductive strands of material in fabric 12 are used in forming a grid of capacitive touch sensor electrodes, sensor performance may be enhanced by ensuring that fabric 12 is uncovered (or only thinly covered) with additional layers of material (e.g., additional fabric layers, plastic layers, etc.). In an uncovered state, a user's fingers can come into close proximity to the intersections between the conductive strands in a capacitive touch sensor grid, thereby enhancing signal-to-noise ratios.

Particularly in configurations in which fabric 12 forms an outer surface of some or all of item 10, it may be desirable to visually hide conductive strands 20C and 18C. For example, it may be desirable to match the appearance of conductive strands 20C and 18C to insulating strands 20I and 18I, so that strands 20C and 18C are visually indistinct from strands 20I and 18I. In this way, fabric 12 may have a desired outward appearance even in the presence of conductive strands that are being used to gather touch sensor input for a fabric touch sensor or that are being used to route signals for other components.

With one illustrative arrangement, the appearance of insulating and conductive strands may be matched by coating the insulating and conductive strands with similarly or identically colored polymer coatings or other surface treatment, by coating metal wires with colored polymer to match the color of solid polymer fibers, etc. With another illustrative arrangement, conductive fibers may be embedded in the center of a bundle of insulating fibers. In this way, the outer insulating fibers that surround the interior conductive fibers may help shield the interior conductive fibers from view.

Figure 3:
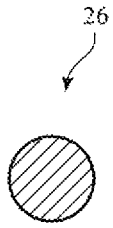
FIG. 3 is a cross-sectional side view of an illustrative fiber in accordance with an embodiment.
Figure 4:
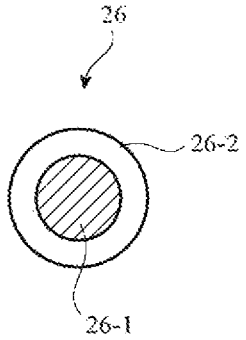
FIG. 4 is a cross-sectional view of an illustrative fiber with a core and an outer coating in accordance with an embodiment.
Figure 5:
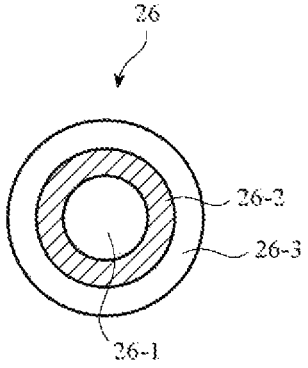
FIG. 5 is a cross-sectional view of an illustrative fiber with a core and two coating layers in accordance with an embodiment.

FIGS. 3, 4, and 5 are cross-sectional side views of illustrative fibers (sometimes referred to as monofilaments) that may be used in forming insulating and conductive yarns.

In the example of FIG. 3, fiber 26 is formed from a single material. In insulating fibers, the material may be a polymer, a natural insulating material such as cotton, flax, silk, or wool, or other dielectric. In conductive fibers, the material may be a conductive material such as metal (e.g., copper).

In the example of FIG. 4, fiber 26 has a core portion such as fiber core 26-1 and has an exterior coating layer such as coating 26-2. In insulating fibers, core 26-1 and coating 26-2 may be polymers, natural materials, or other dielectric. For example, core 26-1 may be formed from a polymer that exhibits desired properties for use in fabric 12 such as strength and elasticity, whereas coating 26-2 may be a colored polymer that is used to impart fiber 26 with a desired color or other appearance. In conductive fibers, core 26-1 of FIG. 4 may be a conductive material (e.g., copper) and exterior coating 26-2 may be a polymer (e.g., a colored polymer such as a white, gray, or black polymer or a polymer of other suitable colors such as red, green, blue, etc.). Conductive fibers may also be formed from polymer cores (i.e., core 26-1) coated with metal coatings (i.e., coating 26-2).

If desired, fiber 26 may be formed from three or more layers such as layers 26-1, 26-2, and 26-3 of FIG. 5. In insulating fibers, layers 26-1, 26-2, and 26-3 may be polymers. In conductive fibers, one or more of layers 26-1, 26-2, and 26-3 may be formed from conductive materials such as metal and the remaining layer(s) may be formed from polymer (as examples).

Figure 6:
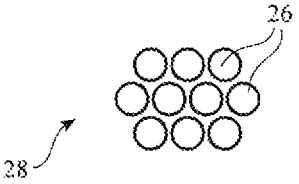
FIG. 6 is a cross-sectional view of an illustrative yarn formed from multiple fibers in accordance with an embodiment.

Yarn may be formed from multiple fibers 26, as illustrated by yarn 28 of FIG. 6. Fibers 26 for yarn 28 may be intertwined by spinning, braiding, or by otherwise intertwining fibers 26. Insulating yarn 28 may be formed from a collection of insulating fibers 26. Conductive yarn may be formed from fibers 26 that are all conductive or may be formed from both insulating and conductive fibers 26.

Figure 7:
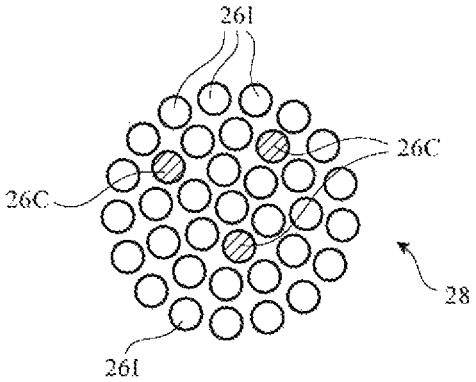
FIG. 7 is a cross-sectional view of an illustrative yarn in which conductive fibers are surrounded by insulating fibers in accordance with an embodiment.

In the example of FIG. 7, yarn 28 includes both insulating fibers 26I and conductive fibers 26C and is therefore conductive. Fibers 26I and fibers 26C may be spun together in a yarn spinning tool or may otherwise be intertwined to form yarn 28 (e.g., using braiding equipment, etc.). Fibers 26C may be bare metal wire (e.g., copper wire) as illustrated by fiber 26 of FIG. 3 or may have multiple layers of material. Because conductive fibers 26C are located in the interior of yarn 28 of FIG. 7, conductive fibers 26C are hidden from view.

Conductive yarns such as yarn 28 of FIG. 7 may visually match the appearance of insulating yarns such as yarn 28 of FIG. 6 that is formed only from insulating fibers 26I (e.g., insulating fibers 26 in yarn 28 of FIG. 6 may be formed from the same polymer that is used in forming the insulating fibers in conductive yarn 28 of FIG. 7). This may make the conductive yarn visually indistinguishable from the insulating yarn. Fabric 12 that is formed using both the insulating and the conducting yarn will therefore appear as if it contains only insulating yarn.

As an example, woven fabric 12 may be formed in which the fabric has insulating warp and weft yarns with interspersed conductive warp and weft yarns as illustrated by insulating strands 20I and 18I of fabric 12 of FIG. 2 and interspersed conductive strands 20C and 18C. In general, insulating strands in fabric 12 such as insulating strands 18I and 20I may be formed from one or more insulating fibers (monofilaments) such as insulating fibers 26 of FIGS. 3, 4, and 5 and/or may be formed from one or more insulating yarns 28, each of which is formed from a set of two or more insulating fibers 26. Likewise, conductive strands in fabric 12 such as conductive strands 18C and 20C may be formed from one or more conductive fibers (monofilaments) such as conductive fibers 26 of FIGS. 3, 4, and 5 and/or may be formed from one or more conductive yarns 28 each of which includes at least some conductive fibers. Configurations in which the insulating strands of fabric 12 are insulating yarns and in which the conductive strands of fabric 12 are conductive yarns may sometimes be described herein as an example.

In arrangements in which fabric 12 includes yarns 28 with multiple fibers, each yarn 28 may contain any suitable number of fibers. As an example, each yarn 28 may contain 2-200 fibers (monofilaments such as monofilaments 26 of FIGS. 3, 4, and 5), may contain 10-150 fibers, may contain 70-160 fibers, may contain more than 10 fibers, may contain 5-55 fibers, may contain more than 20 fibers, may contain more than 100 fibers, may contain fewer than 500 fibers, may contain fewer than 300 fibers, may contain fewer than 150 fibers, may contain 25-35 fibers, may contain fewer than 140 fibers, may contain 10-60 fibers, may contain 34 fibers, or may contain other suitable numbers of fibers.

Each fiber 26 may have a diameter of 8-100 microns, 2-500 microns, more than 5 microns, more than 10 microns, more than 20 microns, more than 40 microns, less than 200 microns, less than 150 microns, less than 100 microns, less than 50 microns, or any other suitable diameter. In configurations in which fibers 26 include coating layers, each coating may have a thickness of 1-40% of the diameter of the fiber, 1-15% of the diameter of the fiber, more than 0.2% of the diameter of the fiber, less than 5% of the diameter of the fiber, less than 35% of the diameter of the fiber, etc.

Fibers 26 and yarns 28 may have any suitable linear density. As an example, yarn 28 may be a 100 denier yarn, may be a 40-200 denier yarn, may be a 70-150 denier yarn, may be a 100 to 130 denier yarn, may be a 110 denier yarn, may have a linear density of more than 10 denier, more than 75 denier, less than 300 denier, less than 180 denier, 50-160 denier, or any other suitable value.

The percentage of conductive fibers in yarn 28 may be 1-10%, more than 2%, more than 10%, more than 50%, 90-100%, less than 70%, less than 15%, or any other suitable value. Yarn 28 may, for example, have 10-50 insulating fibers and 2-10 conducting fibers. With an illustrative arrangement, yarn 28 is 110 denier yarn having 31 insulating fibers (e.g., polymer and/or natural fibers) and 4 conductive fibers (e.g., bare copper wires). The fibers in this illustrative example may all have the same size (e.g., a diameter in the range of 8-100 microns) or may have multiple sizes. If desired, yarn 28 may contain copper wires or other conductive monofilaments intertwined with multifilament insulating or conductive threads or may contain both conducting and insulating multifilament threads.

Yarn 28 may be formed by intertwining fibers 26 using intertwining techniques such as braiding or spinning. Braided yarns may be stiffer than spun yarns. In some fabrics, spun yarn may provide a desired flexible characteristic.

Figure 8:
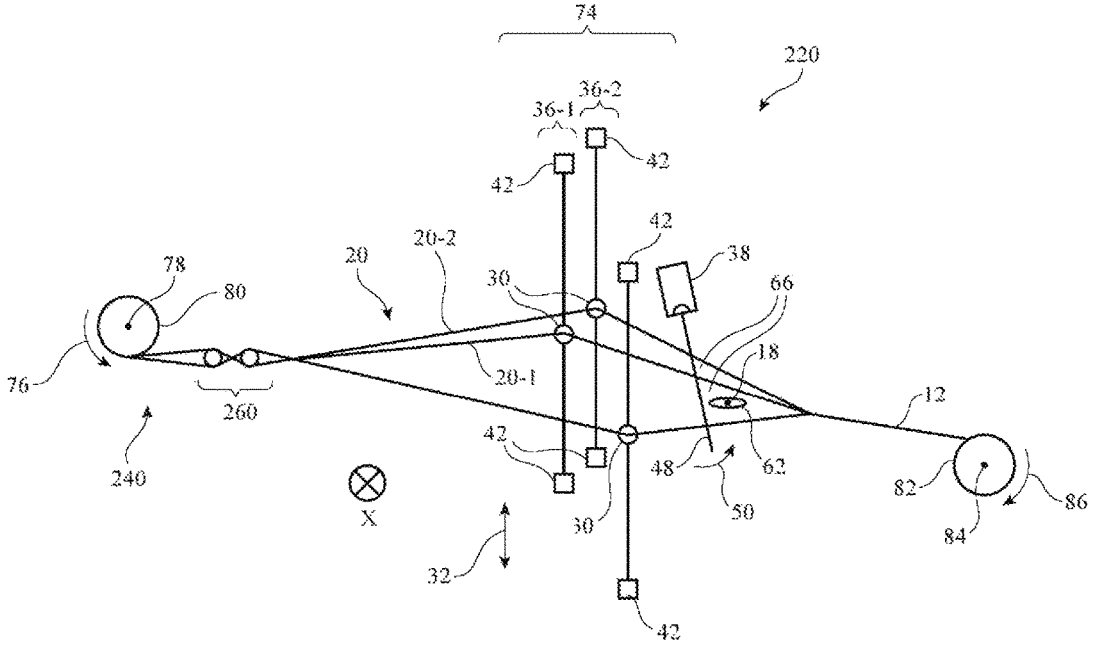
FIG. 8 is a side view of illustrative weaving equipment that may be used to form fabric in accordance with an embodiment.

Illustrative weaving equipment is shown in FIG. 8. Weaving equipment 220 may be used to form fabric 12. The strands of material used in forming fabric 12 may be single-filament strands 26 (sometimes referred to as fibers) or may be multifilament yarns 28.

As shown in FIG. 8, weaving equipment 220 includes a warp strand source such as warp strand source 240. Source 240 may supply warp strands 20 from a warp beam or other strand dispensing structure. Source 240 may, for example, dispense warp strands 20 through rollers 260 and other mechanisms as drum 80 rotates about rotational axis 78 in direction 76.

Warp strands 20 may be positioned using warp strand positioning equipment 74. Equipment 74 may include heddles 36. Heddles 36 may each include an eye 30 mounted on a wire or other support structure that extends between respective positioners 42 (or a positioner 42 and an associated spring or other tensioner). Positioners 42 may be motors (e.g., stepper motors) or other electromechanical actuators. Positioners 42 may be controlled by a controller during weaving operations so that warp strands 20 are placed in desired positions during weaving. In particular, control circuitry in weaving equipment 220 may supply control signals that move each heddle 36 by a desired amount up or down in directions 32. By raising and lowering heddles 36 in various patterns in response to control signals from the control circuitry, different patterns of gaps (sheds) 66 between warp strands 20 may be created to adjust the characteristics of the fabric produced by equipment 220.

Weft strands such as weft strand 18 may be inserted into shed 66 during weaving to form fabric 12. Weft strand positioning equipment 62 may be used to place one or more weft strands 18 between the warp strands forming each shed 66. Weft strand positioning equipment for equipment 220 may include one or more shuttles and/or may include shuttleless weft strand positioning equipment (e.g., needle weft strand positioning equipment, rapier weft strand positioning equipment, or other weft strand positioning equipment such as equipment based on projectiles, air or water jets, etc.).

After each pass of weft strand 18 is made through shed 66, reed 48 may be moved in direction 50 by positioner 38 to push the weft strand that has just been inserted into the shed between respective warp strands 20 against previously woven fabric 12, thereby ensuring that a satisfactorily tight weave is produced. Fabric 12 that has been woven in this way may be gathered on fabric collection equipment such as take-down roller 82. Roller 82 may collect woven fabric 12 as roller 82 rotates in direction 86 about rotational axis 84. Reed 48 and shuttle 62 and/or other weft strand positioning equipment may be controlled by the control circuitry that controls heddles 36, so that warp strand position, weft strand positioning, and reed movement can be controlled in a coordinated fashion.

Positioners 42 may be used to control the vertical position of warp strands 20 when forming fabric 12. As shown in FIG. 8, for example, heddle 36-2 may be placed above heddle 36-1, so that warp strand 20-2 is placed above warp strand 20-1. The ability to determine the heights of warp strands 20 within shed 66 during weaving may be used to help determine which warp strands interact with shuttle 62, so that weaving equipment 220 can manipulate conductive and insulating strands within fabric 12. This allows short circuits and open circuits to be selectively formed at various warp-weft strand intersections, allows electrical components to be coupled to the strands, allows conductive structures such as signal paths (e.g., electrodes, data lines, power paths, etc.) to be formed in fabric 12, and allows other fabric structures to be formed. If desired, some of heddles 36 may contain eyes 30 that are mounted on a common wire. The use of independently adjustable heddles is merely illustrative.

Figure 9:
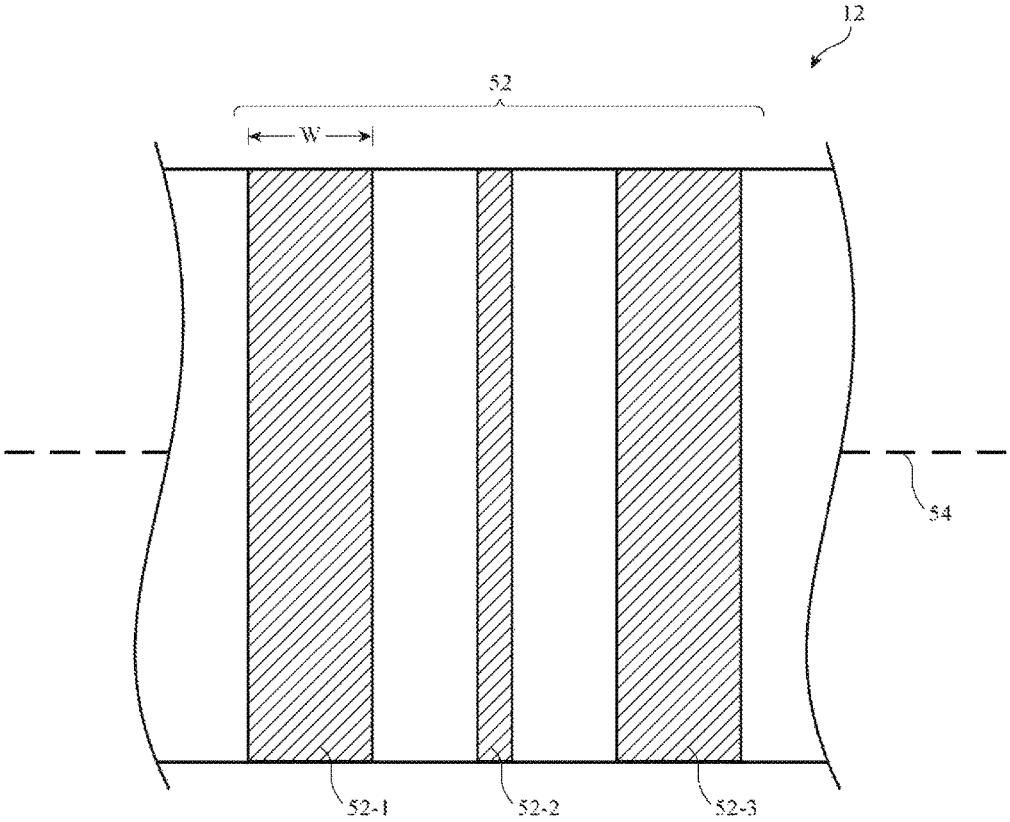
FIG. 9 is a top view of illustrative fabric having conductive signal paths such as a power line, a data line, and a ground line in accordance with an embodiment.

In some applications, the conductive signal paths in fabric 12 may be several millimeters wide to achieve low resistance and to be able to provide power to an electronic device. In fabric 12 of FIG. 9, for example, fabric 12 has multiple conductive signal paths 52 including a power line such as power line 52-1, a data path such as data path 52-2, and a ground path such as ground path 52-3. One or more of signal paths 52 may have be several millimeters wide. For example, power line 52-1 may have a width W between 70 and 80 millimeters, between 60 and 75 millimeters, between 50 and 100 millimeters, greater than 60 millimeters, or less than 60 millimeters.

In addition to having low resistance, electrical paths 52 in fabric 12 may need to be flexible and able to withstand bending of fabric 12. In particular, fabric 12 may form part of an electronic device (e.g., electronic device 10 of FIG. 1) that is configured to bend along bend axis 54 during normal use. For example, fabric 12 may be a cover for an electronic device that can also be used as a stand for the electronic device (e.g., a stand that can be used to prop the electronic device up for a user to view a display on the electronic device). In situations such as these, a user may bend fabric 12 along bend axis 54 to transition fabric 12 from a flat cover use to a bent stand use. It may therefore be desirable to form electrical paths 52 from conductive strands in fabric 12 so that electrical paths are flexible and able to withstand repetitive bending.

To form electrical paths with sufficiently low resistance, it may be desirable to group several conductive strands together in fabric 12. For example, power line 52-1 may be formed from between 450 and 500 conductive strands, between 400 and 450 conductive strands, between 300 and 600 conductive strands, more than 500 strands, or less than 500 strands.

Figure 10:
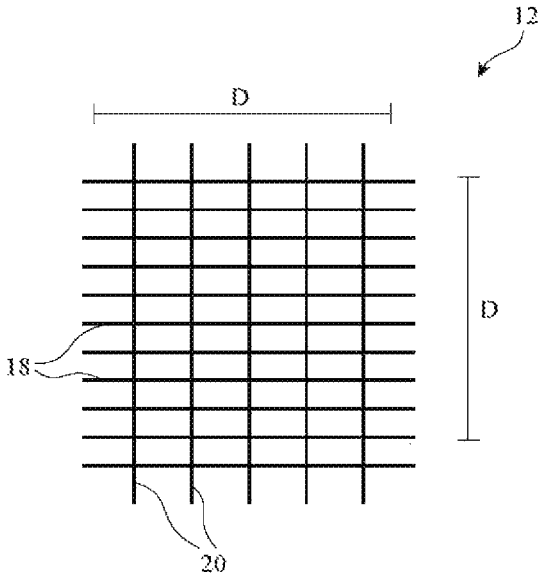
FIG. 10 is a top view of an illustrative fabric in which conductive weft strands have higher density than insulating warp strands in accordance with an embodiment.
Figure 11:
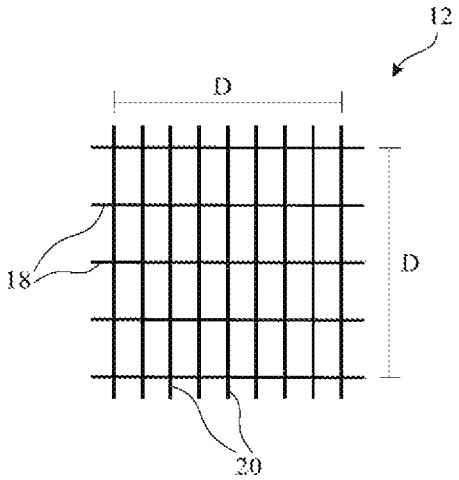
FIG. 11 is a top view of an illustrative fabric in which conductive warp strands have higher density than insulating weft strands in accordance with an embodiment.

By grouping together conductive strands in fabric 12, more short-circuiting between the conductive strands will occur to achieve an electrical path with low resistance. FIGS. 10 and 11 illustrate how conductive strands in fabric 12 may be packed more tightly together than insulating strands in fabric 12 to achieve more short-circuiting between conductive strands. In the example of FIG. 10, weft strands 18 are conductive and warp strands 20 are insulating. In the example of FIG. 11, warp strands 20 are conductive and weft strands 18 are insulating.

As shown in FIG. 10, weft strands 18 are packed more tightly than warp strands 20. In particular, the number of weft strands 18 in distance D may be greater than the number of warp strands 20 in the same distance D. The number of weft strands in an inch of fabric is sometimes referred to as the number of picks per inch (PPI). The number of warp strands in an inch of fabric is sometimes referred to as the number of ends per inch (EPI). In the example of FIG. 10, weft strands 18 are conductive and warp strands 20 are insulating, so the number of picks per inch in fabric 12 may be greater than the number of ends per inch in fabric 12. For example, the picks per inch of fabric 12 may be 200 or greater, while the ends per inch of fabric 12 may be 200 or less. If desired, the number of warp strands on the beam may be 12,000 or less to reduce the space between conductive weft strands 18.

As shown in FIG. 11, weft strands 18 are insulating and warp strands 20 are conductive, so warp strands 20 are packed more tightly than weft strands 18. In particular, the number of warp strands 20 in distance D may be greater than the number of weft strands 18 in the same distance D. In other words, the number of ends per inch may be greater than the number of picks per inch when warp strands 20 are used as the conductive strands in fabric 12.

Figure 12:
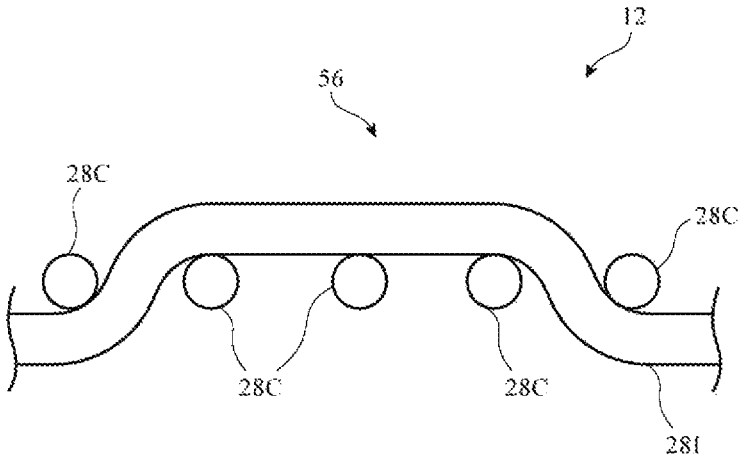
FIG. 12 is a cross-sectional side view of illustrative fabric in which an insulating strand floats over three conductive strands in accordance with an embodiment.

FIG. 12 illustrates another principle of fabric construction that may maximize the short-circuiting between adjacent conductive strands in fabric 12. As shown in FIG. 12, fabric 12 may include conductive strands 28C and insulating strands 28I. Conductive strands 28C may be weft strands and insulating strands 28I may be warp strands, or conductive strands 28C may be warp strands and insulating strands 28I may be weft strands. Fabrics such as fabric 12 may have one or more floats such as float 56. A weft float occurs when a weft strand passes over two or more warp strands. A warp float occurs when a warp strand passes over two or more warp strands. In the example of FIG. 12, insulating strand 28I floats over three conductive strands 28C, helping to pinch conductive strands 28C together. In arrangements of the type shown in FIG. 10 where weft strands 18 are conductive, fabric 12 may be woven in a pattern that includes warp floats that pass over two, three, or more than three weft strands. In arrangements of the type shown in FIG. 11 where warp strands 20 are conductive, fabric 12 may be woven in a pattern that includes weft floats that pass over two, three, or more than three warp strands.

Figure 16:
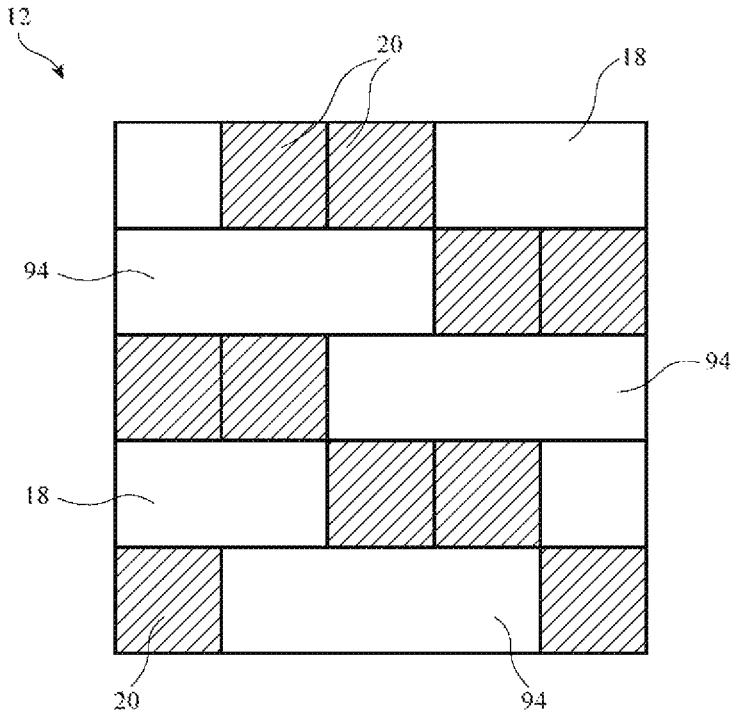
FIG. 16 is a fabric having a construction of the type shown in FIG. 15 in accordance with an embodiment.
Figure 17:
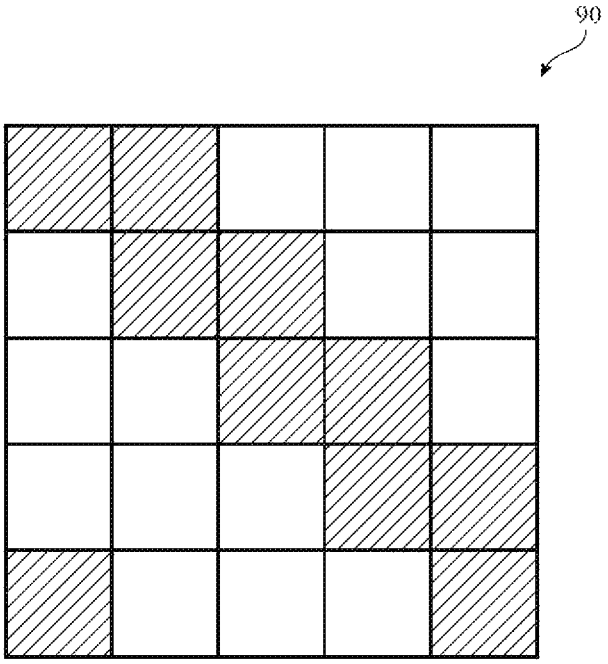
FIG. 17 is a weaving diagram of a two up and three down modified twill pattern with conductive weft strands and insulating warp strands in accordance with an embodiment.
Figure 18:
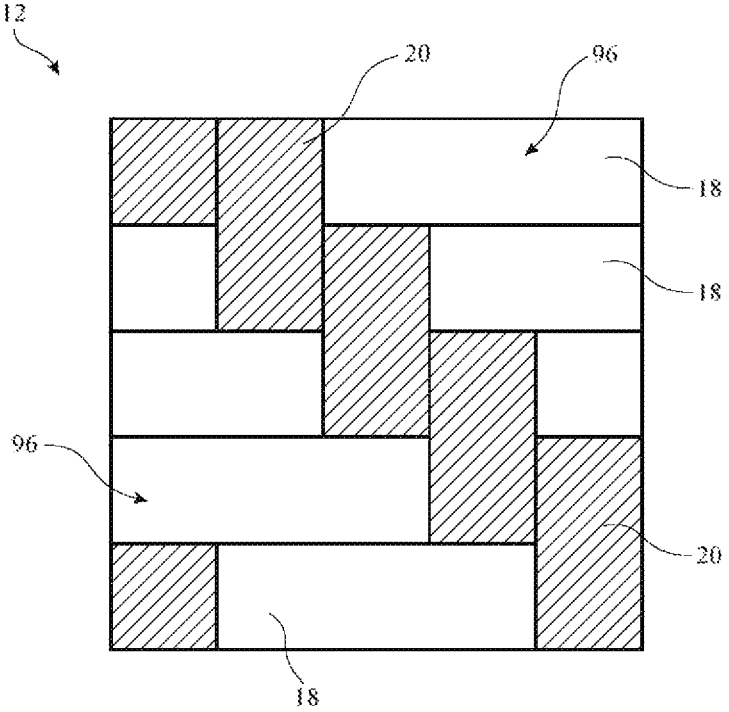
FIG. 18 is a fabric having a construction of the type shown in FIG. 17 in accordance with an embodiment.

FIGS. 13-24 show different fabric constructions that may provide satisfactory short circuiting between conductive strands in fabric 12. The weaving diagrams of FIGS. 13, 15, 17, 19, 21, and 23 show how a loom may be instructed to operate. The shaded squares show when a warp strand is on top (e.g., when one of warp strands 20 of FIG. 8 is raised up above shed 66), and the non-shaded squares show when a weft strand is on top (e.g., when one of warp strands 20 of FIG. 18 is lowered below shed 66). Each weaving diagram is followed by an illustration of the fabric that may be produced with that weaving diagram.

Figure 13:
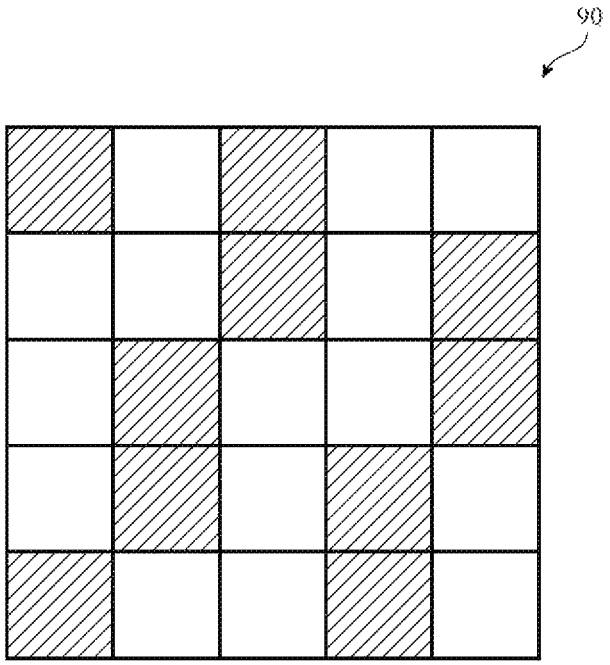
FIG. 13 is a weaving diagram of a two up and three down twill pattern with conductive weft strands and insulating warp strands in accordance with an embodiment.
Figure 14:
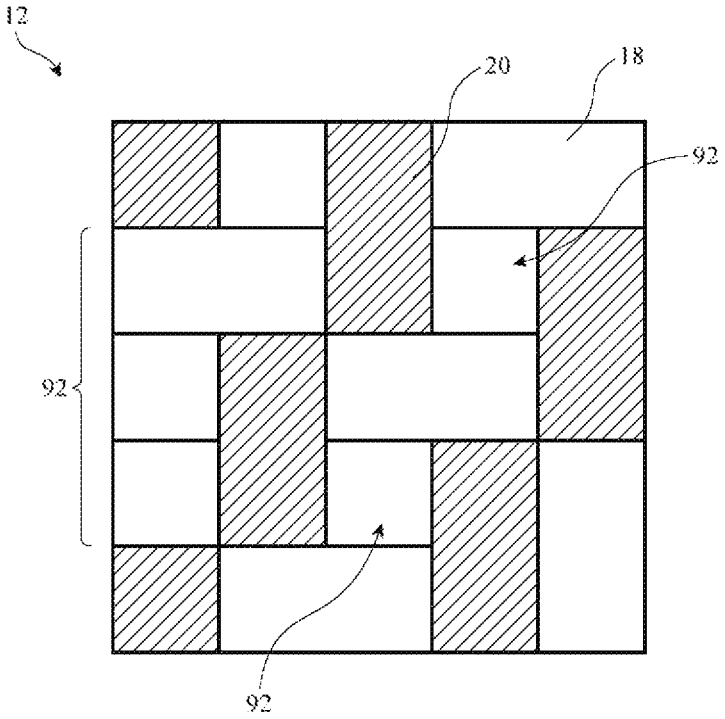
FIG. 14 is a fabric having a construction of the type shown in FIG. 13 in accordance with an embodiment.

Weaving diagram 90 of FIG. 13 illustrates a two up and three down twill pattern in which weft strands 18 are conductive and warp strands 20 are insulating. With this type of pattern, for every five warp strands 20 in shed 66, the first and third warp strands 20 are up and the second, fourth, and fifth warp strands 20 are down. This type of weaving produces a fabric of the type shown in FIG. 14. As shown in FIG. 14, the fabric construction of FIG. 13 results in regions such as regions 92 in which three conductive weft strands 18 are in contact with one another (and not separated by insulating warp strands 20).

Figure 15:
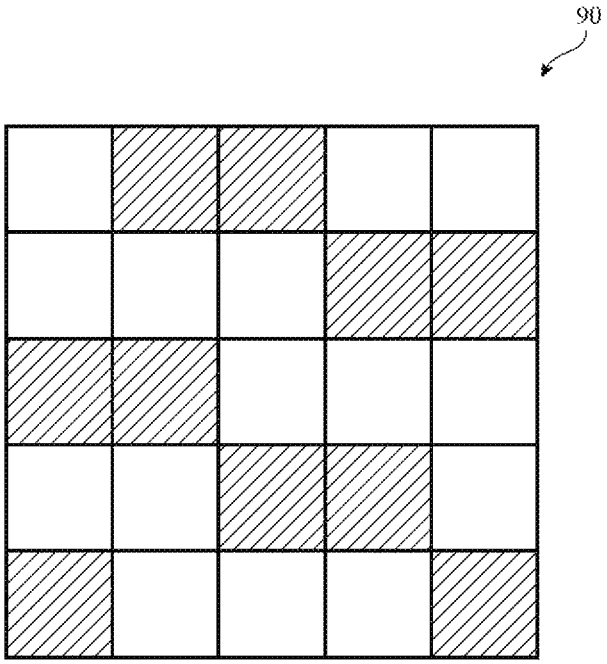
FIG. 15 is a weaving diagram of a two up and three down twill pattern with conductive warp strands and insulating weft strands in accordance with an embodiment.

Weaving diagram 90 of FIG. 15 illustrates a two up and three down twill pattern in which warp strands 20 are conductive and weft strands 18 are insulating. With this type of pattern, for every five warp strands 20 in shed 66, the second and third warp strands 20 are up and the first, fourth, and fifth warp strands 20 are down. This type of weaving produces a fabric of the type shown in FIG. 16. As shown in FIG. 16, the fabric construction of FIG. 15 results in regions such as regions 94 in which three conductive warp strands 20 are in contact with one another (and not separated by insulating weft strands 18). Since FIG. 15 is a top view of fabric 12 and shows which yarns are on top, regions 94 are formed from groups of "down" warp strands 20 and are located on the opposing side of fabric 12 below weft strands 18.

Weaving diagram 90 of FIG. 17 illustrates a two up and three down modified twill pattern in which weft strands 18 are conductive and warp strands 20 are insulating. With this type of pattern, for every five warp strands 20 in shed 66, the first and second warp strands 20 are up and the third, fourth, and fifth warp strands 20 are down. This type of weaving produces a fabric of the type shown in FIG. 18. As shown in FIG. 18, the fabric construction of FIG. 17 results in regions such as regions 96 in which four conductive weft strands 18 are in contact with one another (and not separated by insulating warp strands 18).

Figure 19:
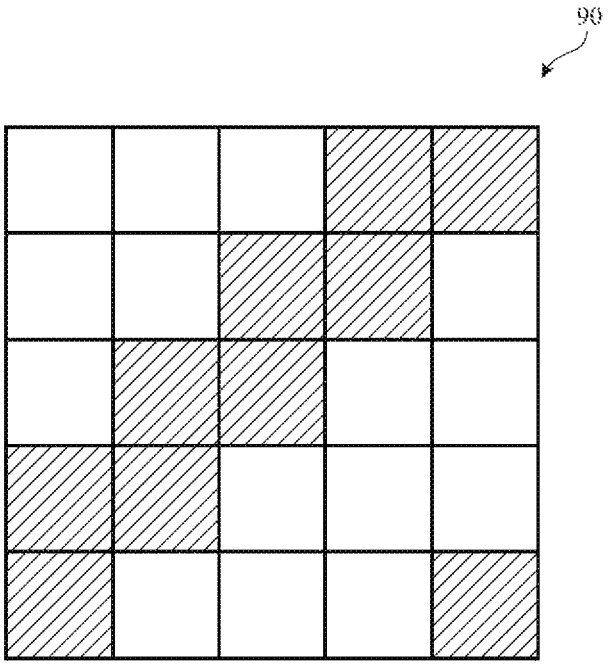
FIG. 19 is a weaving diagram of a two up and three down modified twill pattern with conductive warp strands and insulating weft strands in accordance with an embodiment.
Figure 20:
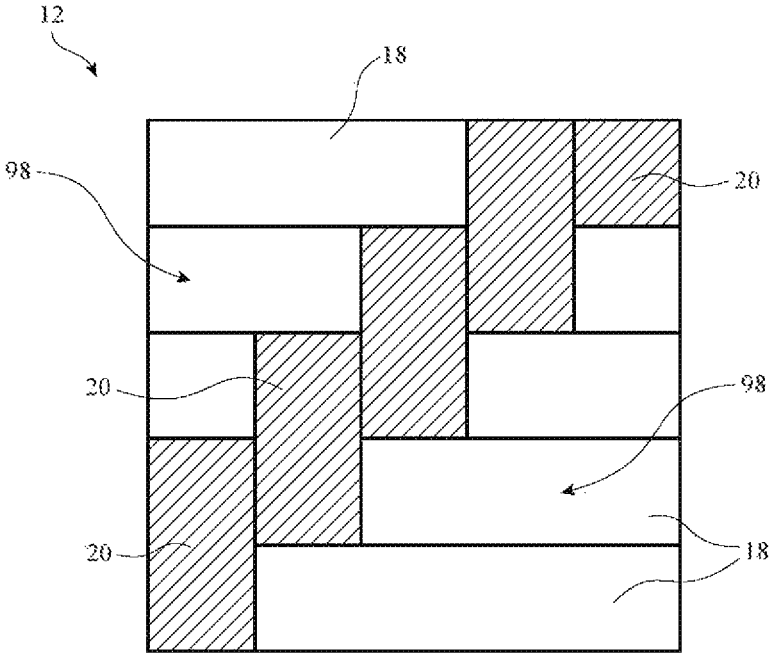
FIG. 20 is a fabric having a construction of the type shown in FIG. 19 in accordance with an embodiment.

Weaving diagram 90 of FIG. 19 illustrates a two up and three down modified twill pattern in which warp strands 20 are conductive and weft strands 18 are insulating. With this type of pattern, for every five warp strands 20 in shed 66, the first, second, and third warp strands 20 are down and the fourth and fifth warp strands 20 are up. This type of weaving produces a fabric of the type shown in FIG. 20. As shown in FIG. 20, the fabric construction of FIG. 19 results in regions such as regions 98 in which four conductive warp strands 20 are in contact with one another (and not separated by insulating weft strands 18). Since FIG. 20 is a top view of fabric 12 and shows which yarns are on top, regions 98 are formed from groups of "down" warp strands 20 and are located on the opposing side of fabric 12 below weft strands 18.

Figure 21:
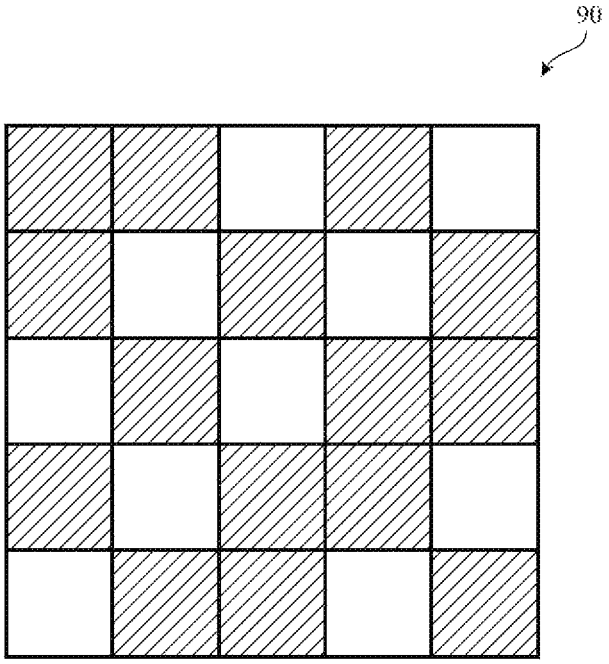
FIG. 21 is a weaving diagram of a three up and two down twill pattern with conductive weft strands and insulating warp strands in accordance with an embodiment.
Figure 22:
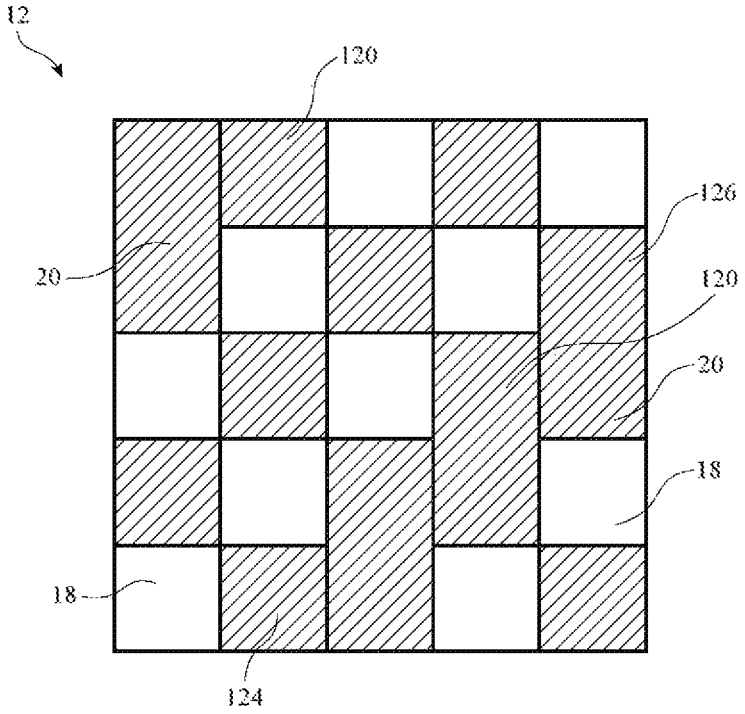
FIG. 22 is a fabric having a construction of the type shown in FIG. 21 in accordance with an embodiment.

Weaving diagram 90 of FIG. 21 illustrates a three up and two down twill pattern in which weft strands 18 are conductive and warp strands 20 are insulating. With this type of pattern, for every five warp strands 20 in shed 66, the first, second, and fourth warp strands 20 are up and the third and fifth warp strands 20 are down. This type of weaving produces a fabric of the type shown in FIG. 22. As shown in FIG. 22, the fabric construction of FIG. 21 results in regions such as regions 120 in which multiple groups of two conductive weft strands 18 are in contact with one another along a diagonal. In this way, a weft strand in location 124 may be electrically connected to a weft strand in location 126, even though there are two strands in between. Since FIG. 22 is a top view of fabric 12 and shows which yarns are on top, regions 120 are formed from groups of weft strands 18 that are located on the opposing side of fabric 12 below warp strands 20.

Figure 23:
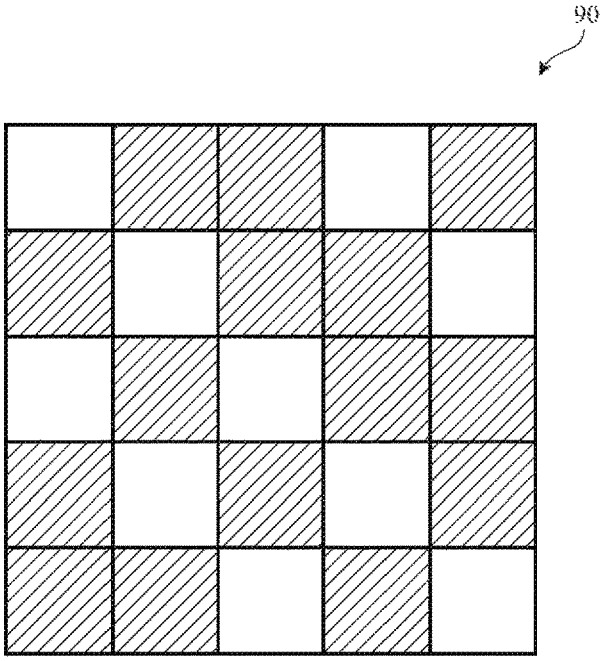
FIG. 23 is a weaving diagram of a three up and two down twill pattern with conductive warp strands and insulating weft strands in accordance with an embodiment.
Figure 24:
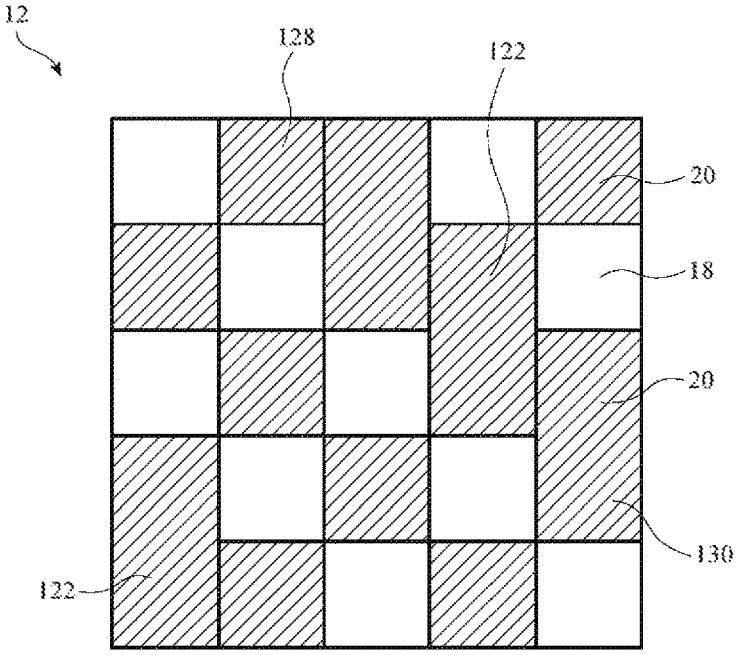
FIG. 24 is a fabric having a construction of the type shown in FIG. 23 in accordance with an embodiment.

Weaving diagram 90 of FIG. 23 illustrates a three up and two down twill pattern in which warp strands 20 are conductive and weft strands 18 are insulating. With this type of pattern, for every five warp strands 20 in shed 66, the second, third, and fifth warp strands 20 are up and the first and fourth warp strands 20 are down. This type of weaving produces a fabric of the type shown in FIG. 24. As shown in FIG. 24, the fabric construction of FIG. 23 results in regions such as regions 122 in which multiple groups of two conductive warp strands 20 are in contact with one another along a diagonal. In this way, a warp strand in location 128 may be electrically connected to a weft strand in location 130, even though there are two strands in between.

The fabric constructions of FIGS. 13-24 are merely illustrative. If desired, other fabric constructions may be used to produce fabric in which multiple conductive strands are shorted together to form a conductive signal path with low electrical resistance.

The foregoing is merely illustrative and various modifications can be made by those skilled in the art without departing from the scope and spirit of the described embodiments. The foregoing embodiments may be implemented individually or in any combination.

What is claimed is:

1. An item, comprising:

insulating yarns that extend in a first direction;

conductive yarns that extend in a second direction, wherein the second direction is orthogonal to the first direction, wherein the conductive yarns are intertwined with the insulating yarns to form fabric having upper and lower surfaces, wherein the insulating yarns have portions on the upper surface of the fabric and portions on the lower surface of the fabric, wherein the portions on the upper surface of the fabric float over at least two conductive yarns to bring the at least two conductive yarns into contact with one another, and wherein a number of insulating yarns per inch in the fabric is less than a number of conductive yarns per inch in the fabric; and control circuitry coupled to the conductive yarns.

2. The item defined in claim 1 wherein the insulating yarns are warp yarns and the conductive yarns are weft yarns.

3. The item defined in claim 1 wherein the insulating yarns are weft yarns and the conductive yarns are warp yarns.

4. The item defined in claim 1 wherein a first and third of every five insulating yarns over a given conductive yarn is on the upper surface of the fabric and a second, fourth, and fifth of every five insulating yarns over the given conductive yarn is on the lower surface of the fabric.

5. The item defined in claim 1 wherein a number of conductive yarns per inch is at least 150.

6. The item defined in claim 1 wherein a plurality of the conductive yarns are electrically connected to one another to form a conductive signal path.

7. The item defined in claim 6 wherein the conductive signal path comprises an electrical path selected from the group consisting of: a power line, a data line, and a ground line.

8. The item defined in claim 7 wherein the fabric forms part of an electronic device cover.

9. The item defined in claim 8 wherein the cover has a bend axis where the fabric bends and wherein the conductive signal path intersects with the bend axis.

10. An item, comprising:

insulating warp strands;

conductive weft strands intertwined with the insulating warp strands to form fabric, wherein a first and second of every five insulating warp strands is on a top surface of the fabric and a third, fourth, and fifth of every five insulating warp strands is on a bottom surface of the fabric, wherein a first plurality of the conductive weft strands are electrically connected to one another to form a first conductive signal path, wherein a second plurality of the conductive weft strands are electrically connected to one another to form a second conductive signal path, and wherein the first and second conductive signal paths have different widths; and control circuitry coupled to the conductive weft strands.

11. The item defined in claim 10 wherein the conductive weft strands comprise metal plated strands.

12. The item defined in claim 10 wherein each of the conductive weft strands comprises a bundle of conductive filaments and insulating filaments.

13. The item defined in claim 10 wherein a number of conductive weft strands per inch is at least 150.

14. The item defined in claim 10 wherein a number of insulating warp strands per inch in the fabric is less than a number of conductive weft strands per inch in the fabric.

15. The item defined in claim 10 wherein the first and second conductive signal paths each comprise an electrical path selected from the group consisting of: a power line, a data line, and a ground line.

16. An item, comprising:

a woven fabric having warp and weft strands, wherein three of every five warp strands is on a top surface of the fabric and two of every five warp strands is on a bottom surface of the fabric, and wherein the fabric has conductive portions that form electrical paths of different widths; and control circuitry coupled to the electrical paths.

17. The item defined in claim 16 wherein the warp strands are insulating strands, wherein the weft strands are conductive strands, and wherein the weft strands form the conductive portions of the fabric.

18. The item defined in claim 17 wherein the conductive strands comprise silver plated yarn.

19. The item defined in claim 17 wherein a number of warp strands per inch in the fabric is less than a number of weft strands per inch in the fabric.

20. The item defined in claim 16 wherein the weft strands are insulating strands, wherein the warp strands are conductive strands, and wherein the warp strands form the conductive portions of the fabric.

21. The item defined in claim 20 wherein a number of weft strands per inch in the fabric is less than a number of warp strands per inch in the fabric.

* * * * *